United States Patent [19]

Ishii

[11] Patent Number: 4,893,114

[45] Date of Patent: Jan. 9, 1990

[54] IMAGE DATA PROCESSING SYSTEM

[75] Inventor: Takatoshi Ishii, Tokyo, Japan

[73] Assignee: ASCII Corporation, Tokyo, Japan

[21] Appl. No.: 212,131

[22] Filed: Jun. 28, 1988

Related U.S. Application Data

[63] Continuation of Ser. No. 871,542, Jun. 6, 1986, abandoned.

[30] Foreign Application Priority Data

Jun. 10, 1985 [JP] Japan ..... 60-125794
Sep. 30, 1985 [JP] Japan ..... 60-217310

[51] Int. Cl.[4] ..... G09G 1/16

[52] U.S. Cl. ..... 340/703; 340/735; 340/748; 340/750

[58] Field of Search ..... 340/701, 703, 748, 750, 340/735, 790, 799

[56] References Cited

U.S. PATENT DOCUMENTS 4,149,152 4/1979 Russo ..... 340/703
4,467,322 8/1984 Bell et al. ..... 340/703
4,635,048 1/1987 Nishi et al. ..... 340/701
4,689,613 8/1987 Ikeda ..... 340/703
4,757,309 7/1988 Bowater et al. ..... 340/703

*Primary Examiner*—Gerald Brigance
*Attorney, Agent, or Firm*—Cushman, Darby Cushman

[57] ABSTRACT

An image data processing system operates so that foreground color codes are held in a foreground register, background color codes are held in a background register, and the foreground or background color codes are selectively output by a selector according to the patterns of the pattern data or character fonts to be extended to color codes. Accordingly the pattern data or character font patterns can be extended quickly to the foreground or background color codes.

Also, to extend the same pattern data repetitively and quickly to the foreground or background color codes, a rotator or selector is used to enable the pattern data to be used repetitively, and according to the output value thereof the foreground or background register is selected.

5 Claims, 15 Drawing Sheets

EXPLANTORY VIEW FOR COLOR CODE EXTENSION

IMAGE DATA PROCESSING SYSTEM

This is a continuation of application Ser. No. 871,542, filed June 6, 1986, which was abandoned upon the filing hereof.

BACKGROUND OF THE INVENTION

1. Field of the Invention

The present invention relates to an image data processing system and more particularly to a circuit which extends display data to color codes when writing the display data into a display memory.

2. Description of the Prior Art

Recently, an image memory has been increased in capacity, thereby permitting a multicolor display. That is, in such bulk capacity image memory there is employed a bit map system in which a plurality of bits of display data are made to correspond to one display dot.

Specifically, when displaying a character on a screen, at first, the display pattern of the character is given in terms of a font pattern of "1" or "0" (that is, a binary font pattern). Then, each of the above-mentioned "1" and "0" must be extended to a foreground or background color code and the extended color code must be written into a display memory.

In FIG. 14, there is shown a block diagram of a conventional image data processing system.

In this figure, Timing Controller 1 is used to control the general timing of the image data processing system.

Display Controller 30 creates a display signal to display the screen of a CRT or the like in accordance with the timing provided by Timing Controller 21. That is, Display Controller 30 outputs a display address corresponding to a display position of the screen to Address Bus 51 for a display memory so as to access Display Memory 40. The then memory timing is also provided by Timing Controller 21.

The output data from Display Memory 40 is transmitted via Data Bus 53 for display memory to Parallel-Serial Conversion Circuit 32 in Display Controller 30. Then, the display signal is created by means of a predetermined processing by Display Controller 30.

On the other hand, CPU (microprocessor) 60 executes an image processing program from Image Processing Program Memory 61, prepares addresses and data to be written into Display Memory 40 in accordance with data from Input/Output (I/O) Interface 70, and gives an image memory access request to Timing Controller 21. Here, for I/O Interface 70, RS232C, a modem interface, a disk interface, a mouse interface or the like may be used.

When Timing Controller 21 receives the access request from CPU 60, then it enables both Address Buffer 52 for display memory and Data Bus Buffer 54 for display memory in accordance with a timing not in contention with the display access of Display Controller 30. Concurrently with this, an execution permission is granted to CPU 60. In this way, CPU 60 is able to access only the timing permitted to Display Memory 40.

While running the above-mentioned operation repetitively, CPU 60 writes images (display patterns) into Display Memory 40.

Now, let us consider a case in which a pattern to be displayed is character information.

FIG. 15 is an explanatory view for color code extension, in which examples of character patterns to be converted to color codes as well as examples of color codes obtained when the character patterns are partially extended are illustrated.

Similarly to the case of characer codes, character fonts are given in terms of binary fonts (data of 1 or 0). Display Memory 40 is assumed to be a memory which employs a bit map system holding, for example, 16-color 4-bit information for each dot. Also, it is assumed that a foreground (color of a display character) color code is "1010" and a background (color of the background of a display character) color code is "0100".

CPU 60, while checking the above-mentioned character font data bit by bit, arranges the foreground or background color codes correspondingly to "1" or "0" of the bit, as shown in FIG. 15, and transmits the arranged color codes to Display Memory 40 as write data.

Up to now, most conventional character display is achieved using a character generator system, but not by using the above-mentioned bit map system. In the case of the character generator system, if character codes and attribute color codes are written into a display memory, then the extension from the character codes to character fonts as well as the extension from the character fonts to display color codes are executed by hardware previously existing. Therefore, in the character generator system, the extension to the color codes can be processed at a very high speed.

On the contrary, in the bit map system in which a CPU is used to extend the character codes to the color codes with processing time required, the extension to the color codes requires a very long time.

In other words, while CPU 60 is inherently capable of processing a byte or 2 bytes (word) very simply and speedily, it requires a very long time, though not impossible, for CPU 60 to extend data bit by bit while checking it, that is, to rearrange 1 byte of data while expanding the data to a bit string correspondingly to the patterns thereof.

Although it is clear that an image display system capable of a graphic display in the bit map system is of higher grade then a text display system, it is disadvantageous in that it requires a long time for its display processings. Especially when the same pattern data is repetitively extended to color codes, the need to reduce the extension time has been strongly urged in the market.

SUMMARY OF THE INVENTION

The present invention aims at eliminating the drawbacks found in the above-mentioned conventional systems.

Accordingly, it is an object of the invention to provide an image data processing system which is capable of extension from pattern data to color codes as well as reducing the time for the color code extension with the bits of the pattern data not handled by a CPU.

It is another object of the invention to provide an image data processing system which is capable of reducing the time for extension when the same pattern data is repetitively extended to color codes.

In achieving the above objects, according to one aspect of the invention, in order to extend pattern data or character font patterns to foreground or background color codes speedily, the foreground color codes are held in a foreground register, the background color codes are held in a background register, and the foreground or background color codes are selectively output by a selector according to the pattern data or character font patterns.

According to another aspect of the invention, in order to extend the same pattern data to foreground or background color codes repetitively and speedily, the foreground color codes are held in a foreground register, the background color codes are held in a background register, the abovementioned pattern data is repetitively enabled by a rotator or selector, the above-mentioned foreground or background register is selected according to the output values thereof.

DETAILED DESCRIPTION OF PREFERRED EMBODIMENTS OF THE INVENTION

Figure 1:
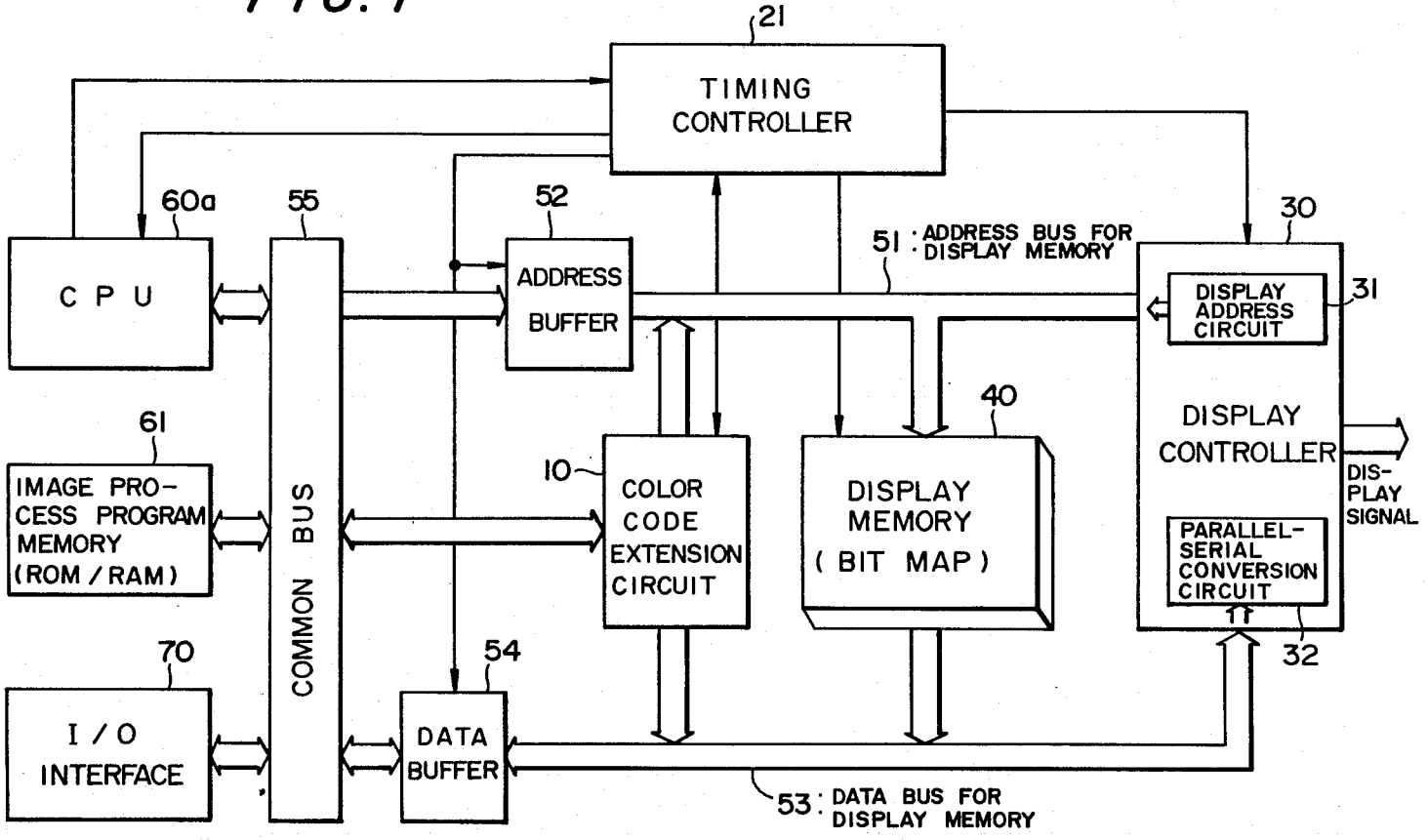
FIG. 1 is a block diagram of an embodiment of the invention.

Referring first to FIG. 1, there is shown a block diagram of a first embodiment according to the invention.

The above embodiment is different from a conventional image data processing system in that it has a color code extension circuit 10 added thereto.

In the above embodiment, when the need for color code extension arises, then CPU 60*a* sets necessary information in Color Code Extension Circuit 10. The, Color Code Extension Circuit 10, under control of Timing Controller 21, executes a color code extension operation and the resultant color codes are written into Display Memory 40. Therefore, according to this embodiment, the speed for processing the color code extension operation is increased when compared with the above-mentioned conventional system in which CPU 60 is used to extend display data to color codes.

Figure 14:
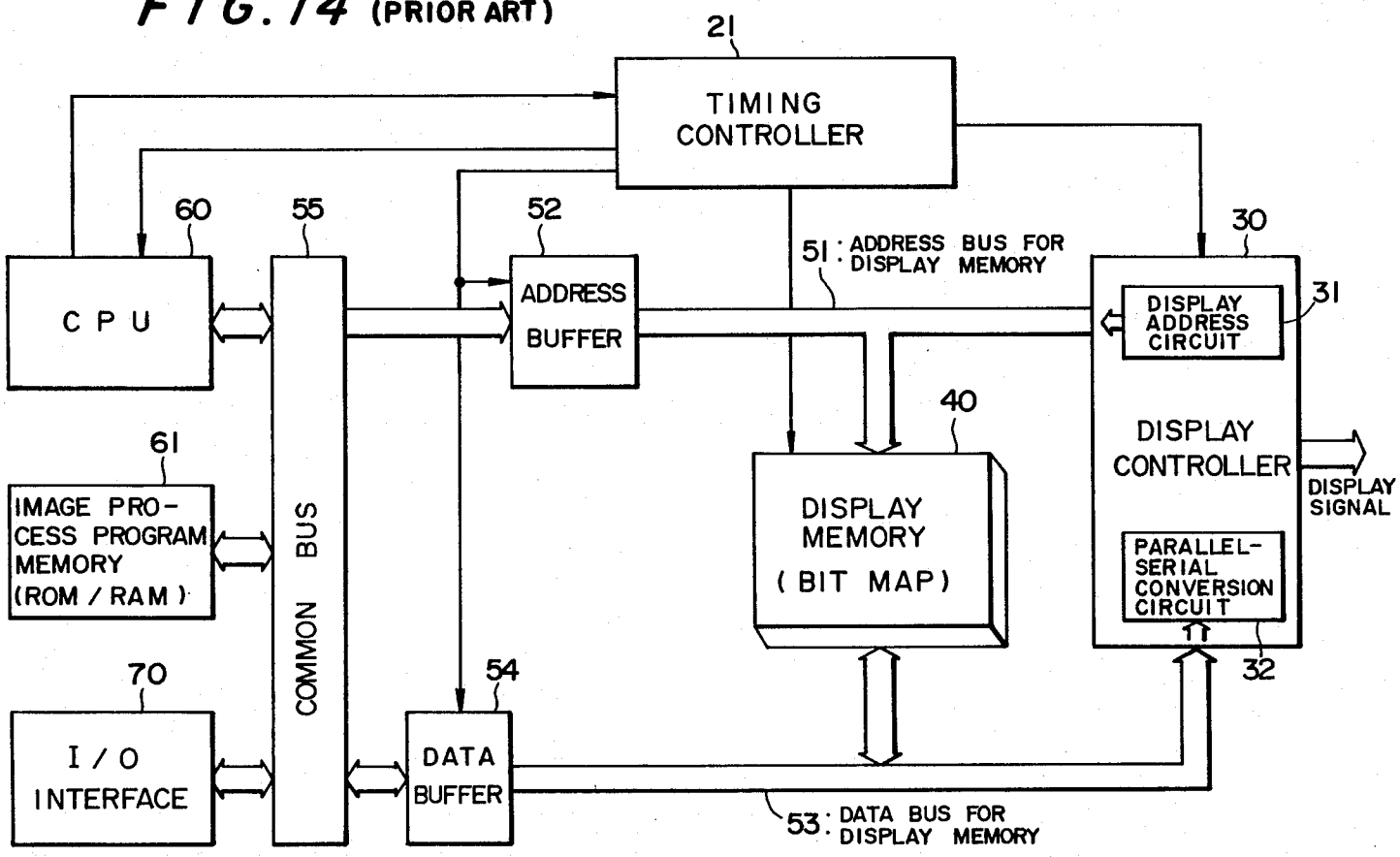
FIG. 14 (PRIOR ART)
FIG. 14 is a block diagram of a conventional image data processing system.

Now, in FIG. 1, the same parts as employed in the prior art system in FIG. 14 are given the same reference characters and the explanations thereof are omitted here. Also, in the following figures as well, the same designations represent the same parts respectively.

Figure 2:
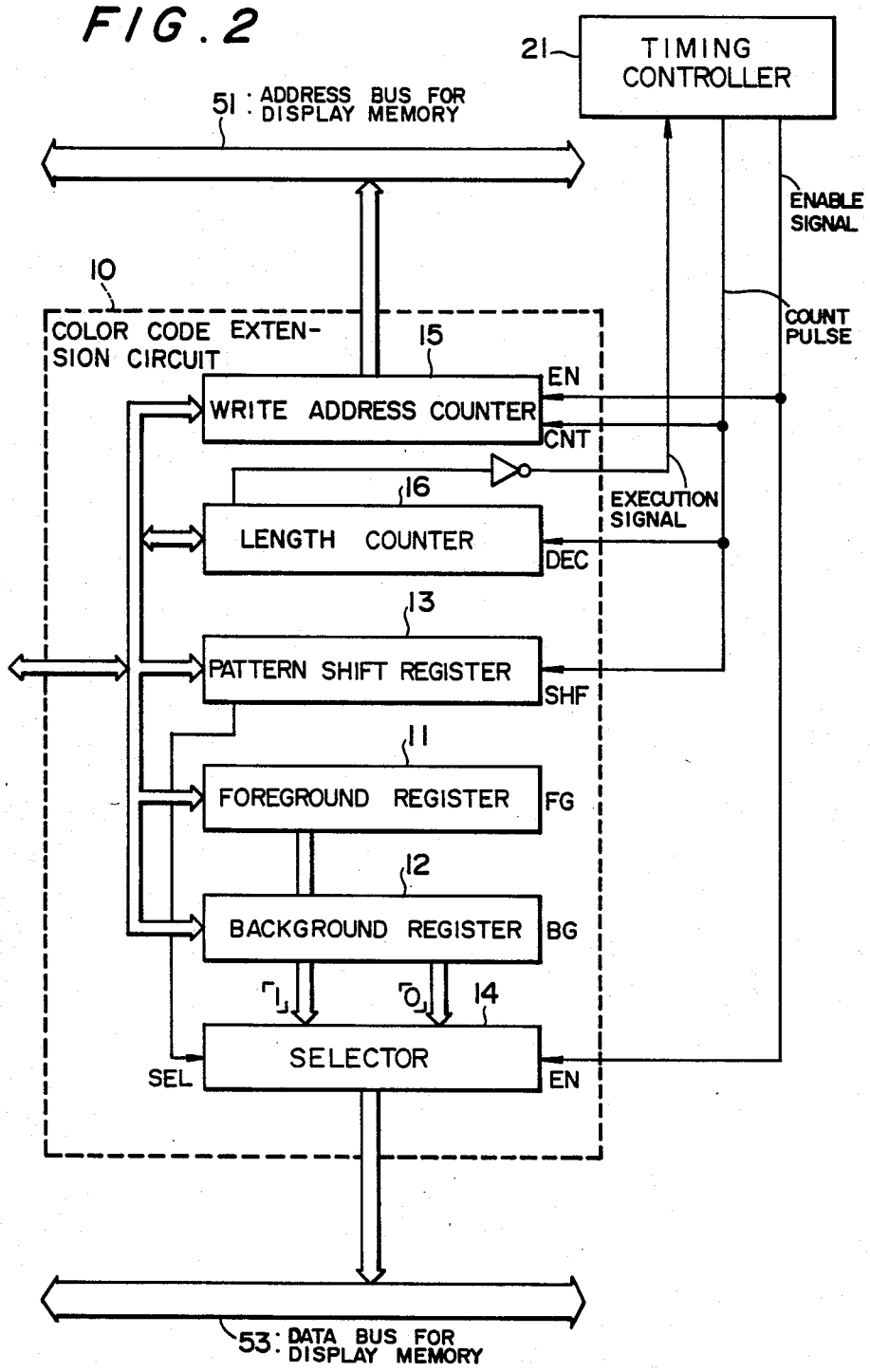
FIG. 2 is a block diagram of a color code extension circuit employed in the above embodiment of the invention.

Referring now to FIG. 2, there is shown a detailed block diagram of a color code extension circuit employed in the above embodiment of the invention.

In FIG. 2, Foreground Register 11 is used to hold foreground color codes therein, while Background Register 12 is dedicated to holding background color codes therein. Pattern Shift Register 13 holds therein the pattern data to be extended to color codes and also shifts the pattern data. Selector 14 outputs selectively the above-mentioned foreground or background color codes in accordance with the contents of high-order bits of Shift Register 13.

Also, Write Address Counter 15 is adapted to hold therein the write addresses to be written into Display Memory 40, and Length Counter 16 is adapted to hold therein the length information of the pattern data to be extended to color codes, namely, a horizontal string of length information on the screen.

Next, the operation of the above-mentioned embodiment will be described.

At first, when the foreground and background color codes to be extended are given, then CPU 60*a* sets the foreground color codes in Foreground Register 11 and the background color codes in Background Register 12.

Next, CPU 60*a* sets the above-mentioned pattern data in Pattern Shift Register 13. Further, CPU 60*a* computes the address to be written into Display Memory 40 and then sets the computed address value in Write Address Counter 15. Then, CPU 60*a* obtains the pattern data for one horizontal line to be extended, and sets the length information on such line in Length Counter 16.

The initial values of Length Counter 16 are all set to 1 (−1) by reset signals. While Length Counter 16 is in minus values, the operation of extension to color codes remains stopped because an execution signal is not given to Timing Controller 21.

Figure 15:
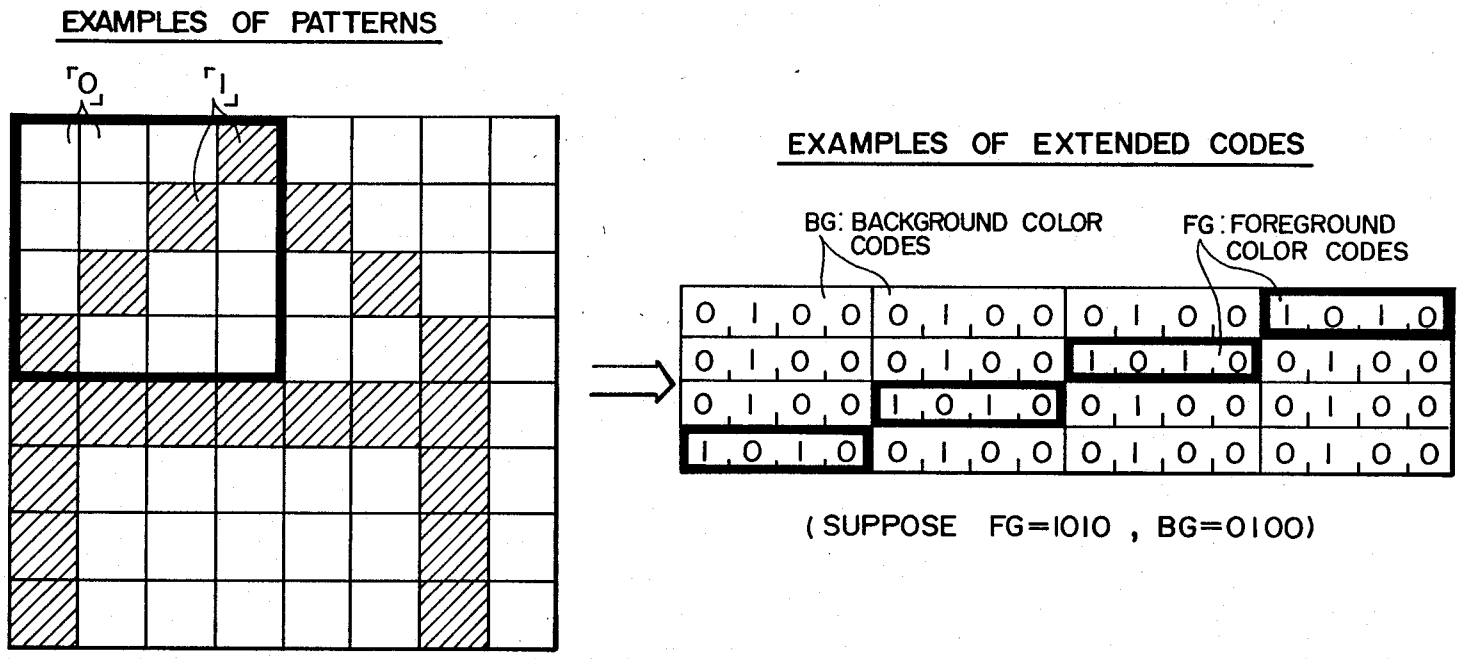
FIG. 15 is an explanatory view to illustrate how display data is extended to color codes.

Now, we will describe here a case in which a pattern of 8×8 dots shown in FIG. 15 is extended to color codes.

In this case, CPU 60*a* sets in Length Counter 16 a value obtained by subtracting 1 from the number of the pattern data to be extended (a value=the number of dots −1). In FIG. 15, there are 8 dots in the horizontal direction, and thus "7" is set in Length Counter 16. After then, an execution signal is given to Timing Controller 21 to inititate its operation.

After receipt of the execution signal, Timing Controller 21 transmits an enable signal in time to a timing permitting access to Display Memory 40, with the result that the value of Write Address Counter 15 is output to Address Bus for Display Memory 51.

Concurrently with this, the value of either Foreground Register 11 or Background Register 12 is selected by Selector 14 in accordance with the value of the high-order bit of Pattern Shift Register 13.

In other words, in the above-mentioned case, when the value of the high-order bit of Shift Register 13 is "1", the foreground is considered to correspond to this, when the foreground color code "1 0 1 0" being held in Foreground Register 11 is output from Selector 14. Also, when the high-order bit of Shift Register 13 is in "0", the background is considered to correspond thereto, when the background color code "0 1 0 0" being held in Background Register 12 is output from Selector 14.

The respective data of the color codes selected in the above-mentioned manner are output to Data Bus for Display Memory 53. And, Timing Controller 21 supplies a timing pulse to Display Memory 40 and the above-mentioned selected data are written into Display Memory 40.

After then, Timing Controller 21 outputs a count pulse to count Write Address Counter 15, decrement Length Counter 16, and left-shift Pattern Shift Register 13.

The above-mentioned operations are repetitively executed for each data of 1 bit being held in Pattern Shift Register 13, and when the value of Length Counter 16 becomes "−1", Length Counter 16 ceases to output the execution signals, so that the above-mentioned color code extension operation is caused to stop.

CPU 60a recognizes the stop of the execution of the above color code extenstion operation by reading the value of Length Counter 16 or by sensing an interrupt signal generating by the execution signal. As a result of such recognition, the pattern data to be extended next, the address to be written into Display Memory 40, and the length data for one horizontal line on the screen to be extended to color codes are set in the respective counters. Add, based on the abovementined data, data corresponding to one line is written into Display Memory 40. These operations are carried out repetitively for necessary lines to complete the writing of one character.

In the foregoing description, it is assumed that the value of Write Address Counter 15 and the memory address for 1 dot in Display Memory 40 correspond to each other at a rate of 1 to 1. However,a plurality of dots of information may be held in one address of Display Memory 40. The invention can apply to such a case as well. In this case, a given function must be added to Timing Controller 21. But, since this is not related directly to the invention, the explanation thereof is omitted here.

Figure 3:
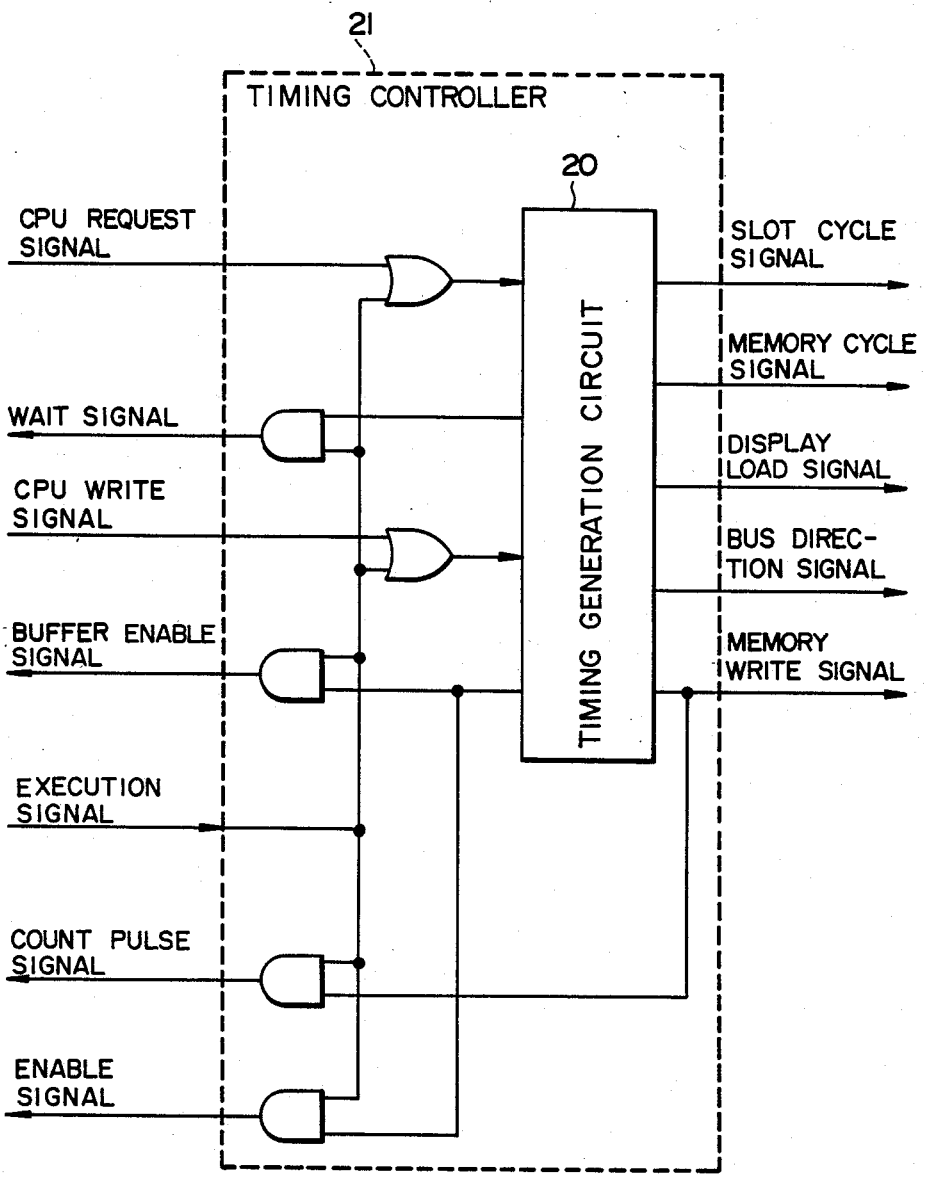
FIG. 3 is a circuit diagram of a timing controller employed in the above embodiment.

Referring now to FIG. 3, there is shown a block diagram to illustrate the details of Timing Controller 21.

Figure 4:
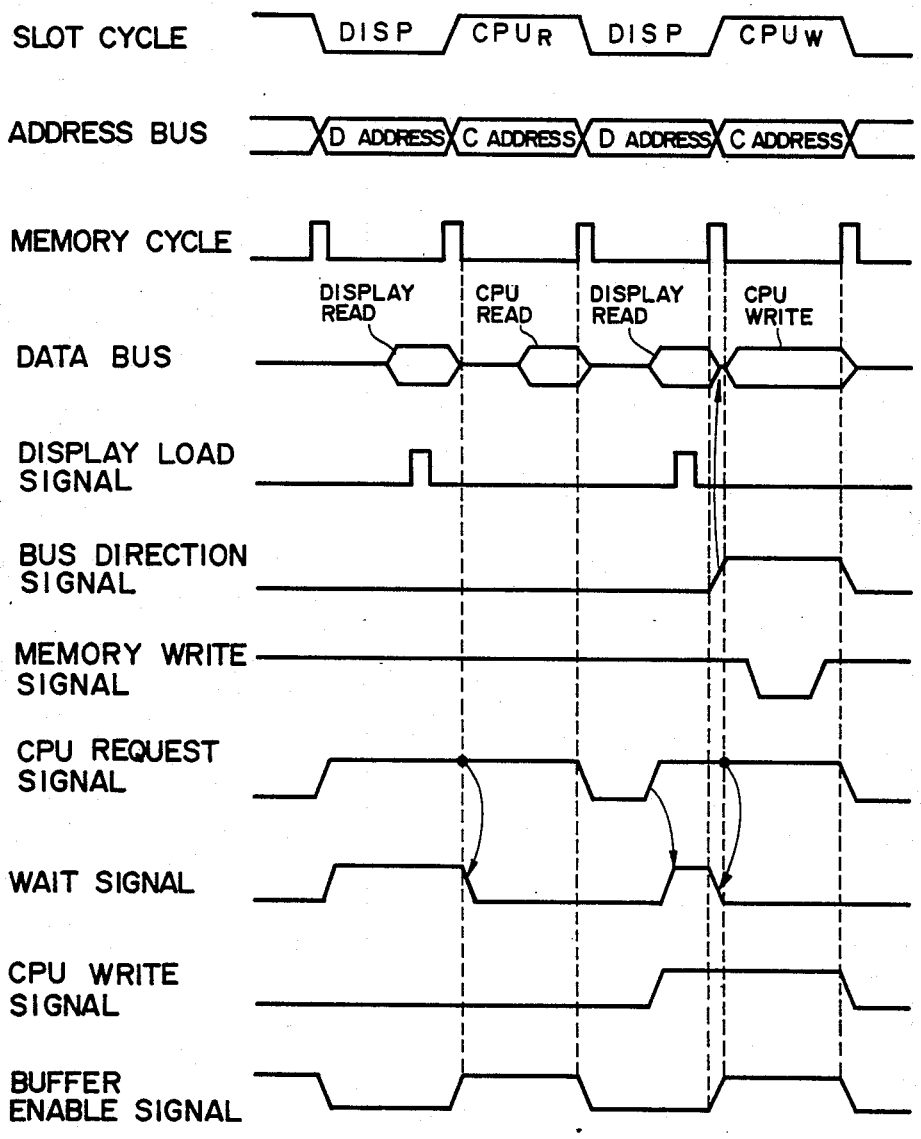
FIG. 4 is a timing diagram to show the operation of the timing controller in FIG. 3.

In FIG. 4, there is shown a timing diagram to illustrate the operation of Timing Controller 21.

The memory cycle of Display Memory 40 is divided into two kinds of time slots (display time slot and CPU time slot).

In the above-mentioned display time slot, at all times, the display address is supplied from Display Address Circuit 31 or Parallel/Serial Conversion Circuit 32 to read out the display data at the same time when the memory cycle is initiated, and the read-out display data is then loaded into Shift Register 32 in Display Controller 30 by a load pulse signal.

On the other hand, in the CPU time slot, when CPU request signals and CPU write signals are received from CPU 60a, then Timing Controller 21 becomes active.

The clocks of the CPU and the Timing Controller are, normally, equipped with oscillators which are independent of each other, and thus, when viewed from Timing Controller 21, the CPU request signals are generated asynchronously.

Timing Controller 21 synchronizes the CPU request signal for queuing. Due to the queuing, until the CPU request is accepted by returning a wait signal, the execution of CPU 60a is placed in the wait state.

When the CPU request is accepted, in the memory cycle of the CPU time slot, reading or writing is executed according to the value of the CPU write signal. While the memory cycle is being executed, a buffer enable signal is turned on and thus an address from the CPU is supplied.

When the CPU write signal is in "0", then the read data from the memory is transmitted to the data bus of CPU 60a. While the CPU write signal is in "1", a bus direction signal goes to "1" and thus data is supplied from the data bus of CPU 60a. Also, a memory write signal is transmitted to Display Memory 40 and thus writing is executed.

The execution signal from Color Code Extension Circuit 10 is processed by Timing Controller 21, quite similarly as with the CPU write signal and CPU request signal from CPU 60a. However, the wait signal and buffer enable signal are forbidden because they are not requested from CPU 60a. In place of them, a count pulse signal is returned to Color Code Extension Circuit 10 in the timing of the memory write signal and an enable signal is returned to Color Code Extension Circuit 10 in the timing of the buffer enable signal.

The enable signal causes a write address and color code data to be output to their respective buses. At the same time, the memory wait signal causes the writing to be executed. At the time of completion of the writing, the count pulse signal updates the contents of the respective registers and counters.

When a positive value is set in the length counter, then the execution signal goes to "1". Then, a writing operation is initiated with the foreground and background corresponding to the dot pattern being considered as the color code data to Display Memory 40. Each time when 1 dot is written, the length counter counts down until it goes to "0".

When the length counter is in "0", the execution signal is still on and thus the writing is executed another time. This causes the length counter to go into "−1" (FF) and the execution signal to go into "0", stopping the execution. As a result of this, the execution is carried out a number of times one more than the value set in Length Counter 16. The execution is wholly carried out according to the timings of Timing Generator Circuit TG, and thus no queuing is necessary. Also, since all of the adjacent CPU time slots are executed effectively, the processings can be completed at a very high speed.

In the above-described embodiment of Timing Controller 21, since the CPU request signal and the execution signal are set equal to each other (that is, they are simply ORed), until the color code extension is completed, Display Memory 40 cannot be accessed.

If there is employed a timing controller which is capable of controlling the CPU request signal and execution signal according to priorities, then the CPU access can be easily realized even while the color code extension is being executed.

Figure 5:
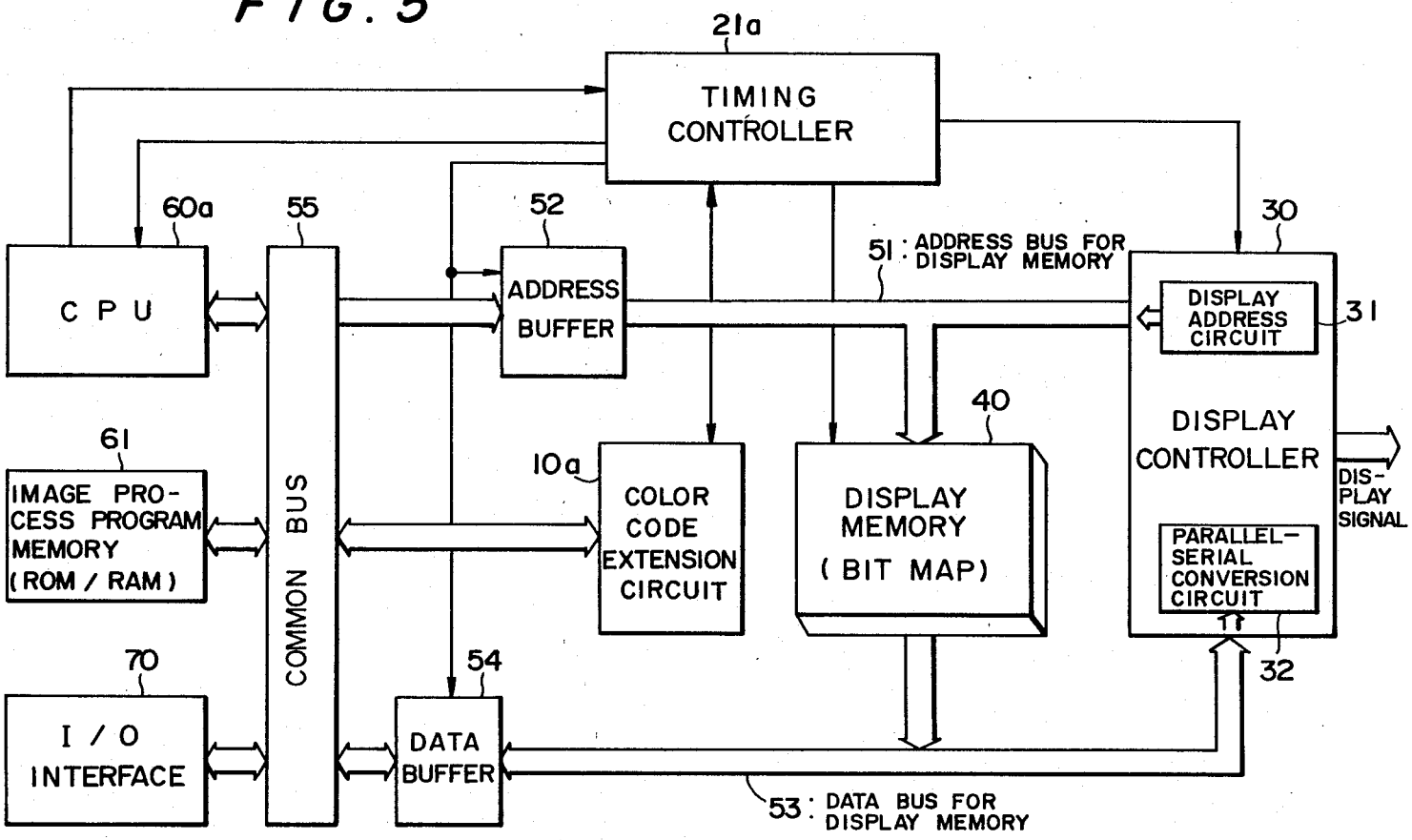
FIG. 5 is a block diagram of a second embodiment of the invention.
Figure 6:
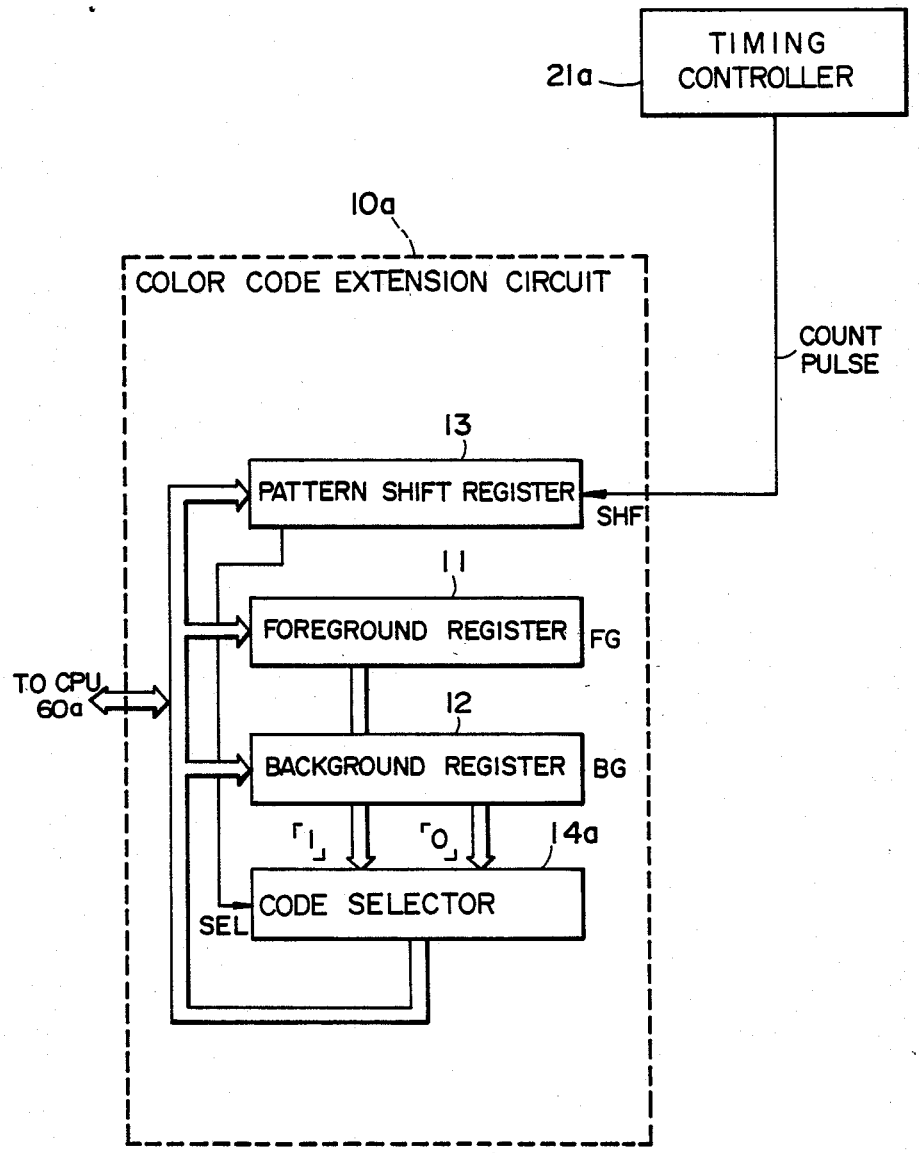
FIG. 6 is a block diagram of a color code extension circuit employed in th second embodiment of the invention in FIG. 5.

FIG. 5 shows a second embodiment according to the invention, and FIG. 6 shows the details of the color code extension circuit illustrated in FIG. 5.

In this embodiment, Write Address Counter 15 and Length Counter 16 are eliminated from the first embodiment shown in FIG. 1. In this case, the functions of Write Address Counter 15 and Length Counter 16 are preferred by CPU 60a.

In other words, CPU 60a is adapted to perform a continuous automatic execution in the color code extension, while Color Code Extension Circuit 10a with the two counters 15, 16 excluded is adapted to execute a simple color code extension only. In this arrangement, although the role of CPU 60a is increased to some degree, the performance of the whole system is enhanced over the conventional system.

Figure 7:
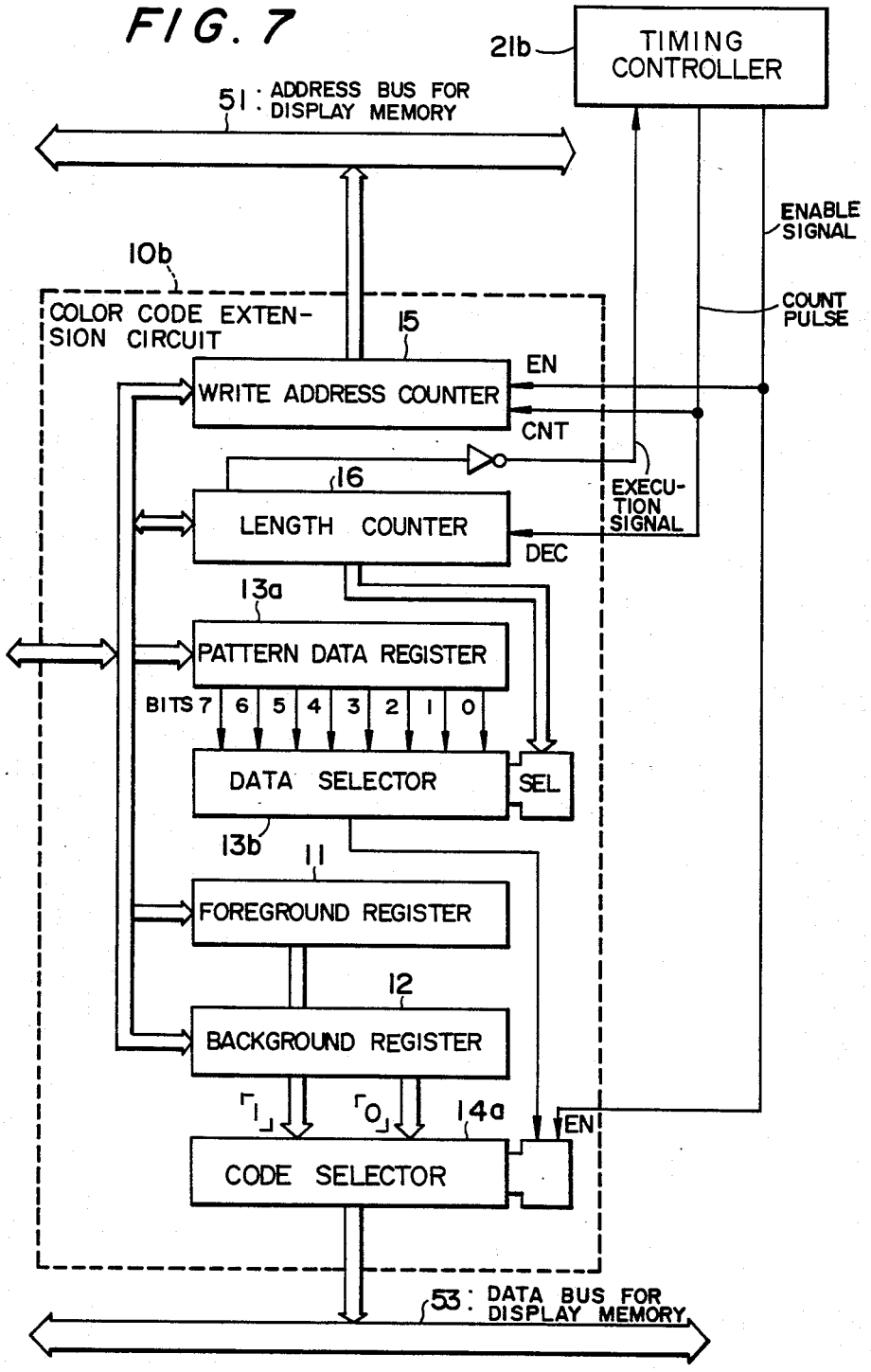
FIG. 7 is a block diagram of another color code extension circuit according to the invention.

Referring now to FIG. 7, there is illustrated a block diagram of another embodiment of the invention.

In this embodiment, when compared with Color Code Extension Circuit 10 shown in FIG. 2, Pattern Shift Register 13 is replaced by Pattern Data Register 13a and Data Selector 13b.

Pattern Data Register 13a is used to hold therein the pattern data to be extended to color codes, while Data Selector 13b is adapted to select sequentially the pattern data from Pattern Data Register 13a. Also, Code Selector 14a is a selector which selects the foreground or background color codes in accordance with the outputs of Data Selector 13b.

Color Code Extension Circuit 10b shown in FIG. 7 is identical basically in operation with Color Code Extension Circuit 10 in FIG. 2, except that Pattern Data Register 13a receives the pattern data from CPU 60a and holds it therein, Data Selector 13b outputs bits from the high-order bits of the pattern data, bit by bit, and in accordance with the output bits the foreground or background is selected by Code Selector 14a. Since Data Selector 13b outputs the bits, bit by bit, out of the pattern data according to the output signals of Length Counter 16, the conversion to the color codes can be initiated even at the intermediate point of Pattern Data Register 13a.

Figure 8:
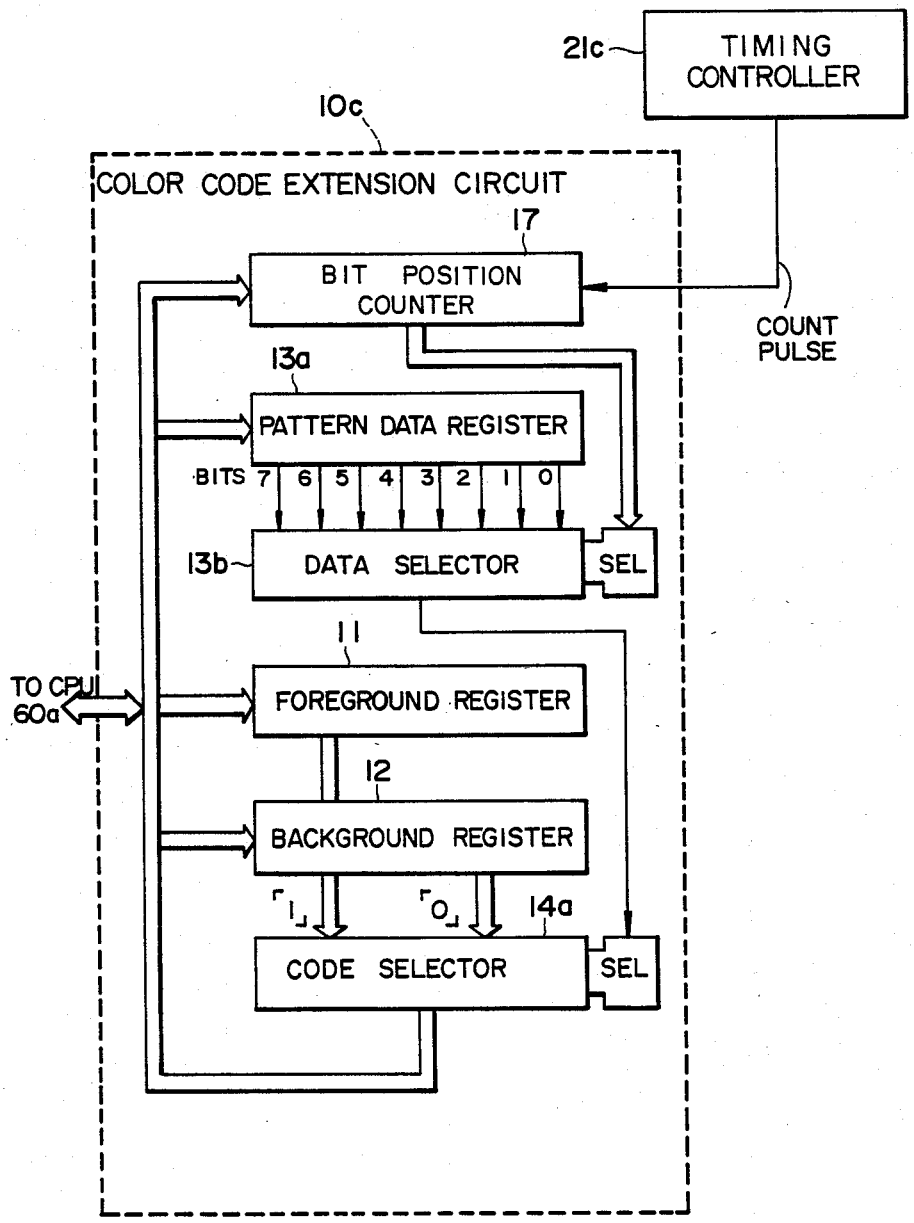
FIG. 8 is a block diagram of a modification of the color code extension circuit in FIG. 7.

In FIG. 8, there is illustrated a block diagram of a modification of the embodiment shown in FIG. 7.

In the modified embodiment in FIG. 8, Write Address Counter 15 and Length Counter 16 are eliminated from the embodiment in FIG. 7, while Bit Position Counter 17 is added thereto. In this case, the functions of Write Address Counter 15 and Length Counter 16 are to be performed by CPU 60a.

That is, the continuous automatic execution in the color code extension is performed by CPU 60a, while Color Code Extension Circuit 10c from which Counters 15, 16 are excluded is adapted to run a simple color code extension operation only. In such an arrangement, although the role of CPU 60a is increased to some extent, the performance of the whole system is enhanced over the prior art system.

Figure 9:
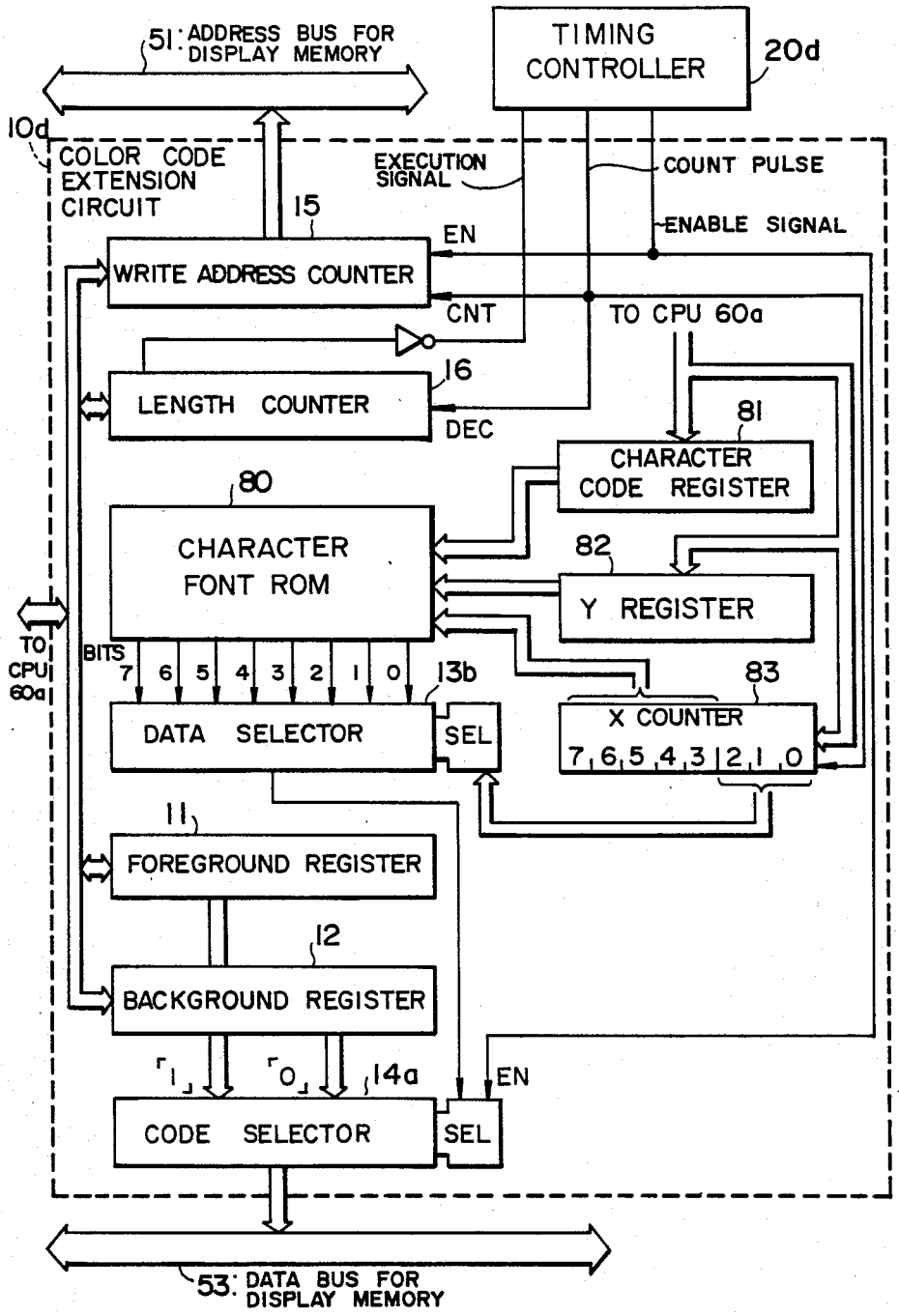
FIG. 9 is a block diagram of still another embodiment of the invention.

Referring now to FIG. 9, there is illustrated a block diagram of another embodiment of the invention.

In this embodiment, there are provided a character font ROM and the like instead of Pattern Data Register 13a in the embodiment shown in FIG. 7, so that character codes can be extended.

Character Font ROM 80 is used to store character font patterns and Character Code Register 81 is dedicated to holding the character codes to be read out. Also, Y Register 82 is adapted to hold the vertical positios of a font pattern for one character in Character Font ROM 80 as well as to set a read-out start point in the vertical direction (Y-direction).

X Counter 83 is a register which counts the horizontal positions (X-direction positions) of the font pattern and sets an extension start point in the horizontal direction (Y direction). Data Selector 13b selects sequentially the character font patterns output from Character Font ROM 80.

Next, the operation of the above-mentioned embodiment will be described below.

CPU 60a transmits the character codes to be converted to color codes to Character Code Register 81. Based on the character codes, the high-order bit of a ROM address is specified, a value to specify the vertical positions in the character font pattern is set from CPU 60a to Y Register 82, and a start position in the horizontal direction (X direction) is set in X Counter 83. Also, the values of Bit 2 and lower bits are used as the select signals of Data Selector 13b and the value of Y Register 82 and the values of Bit 3 and higher bits are used as the lower bits of the addresses of Character Font ROM 80.

Each time X Counter 83 counts up (or counts down) 1, one bit out of the output bits of Data Selector 13b is transmitted to Code Selector 14a as a select signal, and according to the select signal Code Selector 14a outputs a foreground or background code.

When the extension of one horizontal line in the character font pattern is completed from Character Font ROM 80, CPU 60a increments or decrements 1 the value of Y Register 82 to set the value of X Counter 83 again and then the same operations as mentioned above are carried out again so as to achieve conversion to color codes.

In the embodiment shown in FIG. 9, Write Address Counter 15 and Length Counter 16 may be eliminated.

The above-mentioned CPU 60a may not be a general-purpose CPU, buy may be one for video processing which is used exclusively for display processings. Also, the font size of Character Font ROM 80 may be arbitrary both vertically and horizontally, and the length of Character Code Register 81 can be determined in an arbitrary manner. Therefore, the abovementioned character font may be an alphabetic font, a kanji font, or a font for special code. For example, in the embodiment in FIG. 9, a kanji font ROM may be used in place of Character Font ROM 80.

Figure 10:
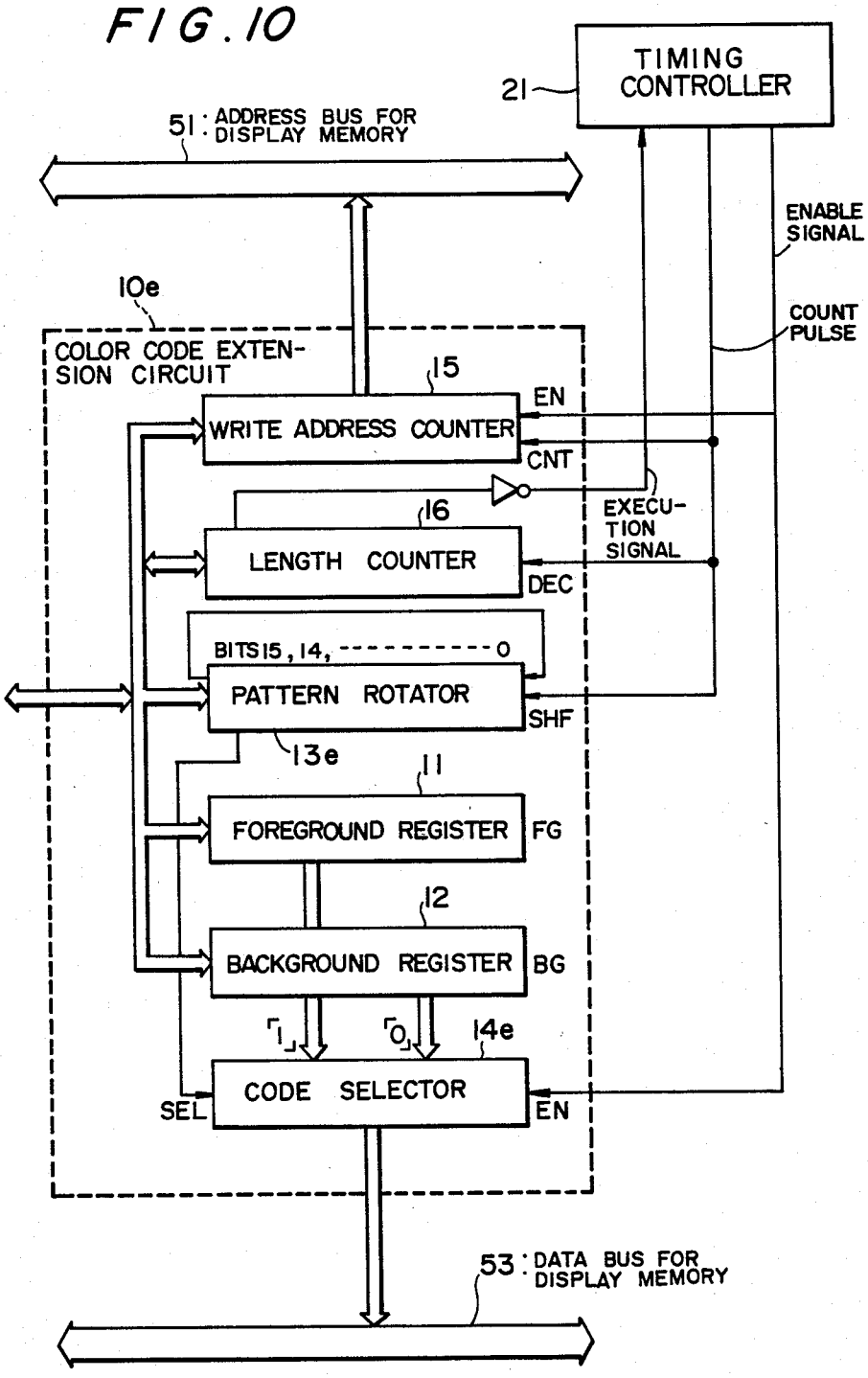
FIG. 10 is a block diagram of a further embodiment of the invention.

Referring now to FIG. 10, there is illustrated a detailed block diagram of a color code extension circuit 10e which is another embodiment of the invention.

This embodiment is different from the previously-described embodiment in FIG. 2 in that Pattern Rotation 13c is used in place of Pattern Register 13.

Pattern Rotator 13e is a register which holds the pattern data to be extended to color codes and also rotates the pattern data. Also, in Pattern Rotator 13e, the highest-order bit is interconnected with the lowest-order bit so that the data can be rotated. Therefore, Pattern Rotator 13e is capable of holding the pattern data to be extended to color codes and forming pattern data repetitively outputting means which outputs the pattern data repetitively.

Code Selector 14e is adapted to output selectively either the foreground color code or the background color code according to the contents of the higher-order bit of Shift Register 13e.

Next, the operation of the embodiment illustrated in FIG. 10 will be described below.

At first, when the foreground and background color codes to be extended are given, CPU 60a sets the foreground color code in Foreground Register 11 and the background color code in Background Register 12.

Then, the above-mentioned pattern data is set in Pattern Rotator 13e. Further, CPU 60a computes the address to be written into Display Memory 40 and thereafter sets the value of the computed address in Address Counter 15. And, CPU 60a obtains the horizontal-direction pattern data to be extended and sets the length information of the horizontal-direction pattern data in Length Counter 16.

The initial values of Length Counter 16 are all set at 1 (−1) by means of a reset signal. While Length Counter 16 is in the negative values, the execution signal is not given to Timing Controller 21 and thus the operation of the color code extension remains stopped.

Here, we will discuss a case in which a pattern of 8 x 8 dots shown in FIG. 10 is extended to color codes.

CPU 60a sets in Length Counter 16 a value obtained by substracting 1 from the number of the pattern data to be extended (that is, a value=the number of dots −1). In the case shown in FIG. 15, there are 8 dots in the horizontal direction and, accordingly, "7" is set in Length Counter 16. Thereafter, the execution signal is given to Timing Controller 21, which initiates the operation.

Subsequently, Timing Controller 21 transmits an enable signal in time with the timing permitting access to Display Memory 40, with the result that the value of Write Address Counter 15 is output to Address Bus for Display Memory 51.

Concurrently with this, the value of Foreground Register 11 or Background Register 12 is selected by Code Selector 14e according to the value of the high-order of Pattern Rotator 13e.

Specifically, in the above embodiment, when the higher bit of Rotator 13e is a "1", then the foreground is considered to correspond to it and thus the color code "1 0 1 0" of the foreground held in Foreground Register 11 is output from Code Selector 14e. Also, when the higher bit of Rotator 13e is a "0", then the background is considered to correspond to it and thus the background color code "0 1 0 0" held in Background Register 12 is output from Code Selector 14e.

The data of the respective color codes in the above-mentioned manner are output onto Data Bus for Display Memory 53. Timing Controller 21 supplies a timing pulse to Display Memory 40 and the selected data are written into Display Memory 40.

Subsequently, Timing Controller 21 outputs a count pulse which counts Write Address Counter 15, decrements Length Counter 16, and rotates Pattern Rotator 13e left.

The above-mentioned operations are repeatedly executed for every data for 1 bit held in Pattern Rotator 13e. When the value of Length Counter 16 becomes "−1", Length Counter 16 is caused to stop the output of the execution signal, so that the above-mentioned color code extension operation is caused to stop.

CPU 60a can recognize the stopping of the color code extension operation by reading the value of Length Counter 16 or by sensing an interrupt signal produced by the execution signal. After recognition of the stopping of the color code extension operation by CPU 60a, the pattern data to be extended next, the address to be written into Display Memory 40, and the horizontal-direction length data on the screen to be converted to color codes are set in the respective counters. And, based on the above-mentioned data, data for 1 line is written into Display Memory 40. These operations are repeatedly carried out for necessary lines so as to complete the writing operation for 1 character.

After the pattern data (for example, data of 16 bits) transmitted from CPU 60a is held in Pattern Rotator 13e, if the data of Bit 15 (the highest-order bit) is transmitted to Code Selector 14e and is converted to a color code, then Pattern Rotator 13e is rotated 1. In this case, the data of Bit 15 just before rotation is moved to Bit 0.

When the second data in Pattern Rotator 13e is converted to a color code, then Pattern Rotator 13e is again rotated 1, with result that the data of Bit 15 just before rotation is moved to Bit 0. These operations are repeated. When the data for 16 bits have all been converted to the color codes, then the data identical with the abovementioed 16-bit data are set in Pattern Rotator 13e.

Here, in order to set in Pattern Rotator 13e another data different from the pattern data previously set therein, another pattern data from CPU 60a may be written into and held in Pattern Rotator 13e, likewise again.

If the same pattern data is again extended to the color codes, it is not necessary for CPU 60a to set the pattern data again, because the pattern data is already in Pattern Rotator 13e.

Therefore, in case when the same pattern data is extended to the color codes two or more times, CPU 60a is not required to set the pattern data each time. As a result of this, when the same pattern data is extended repetitively to the color codes, the speed of the extension operation is increased accordingly.

Figure 11:
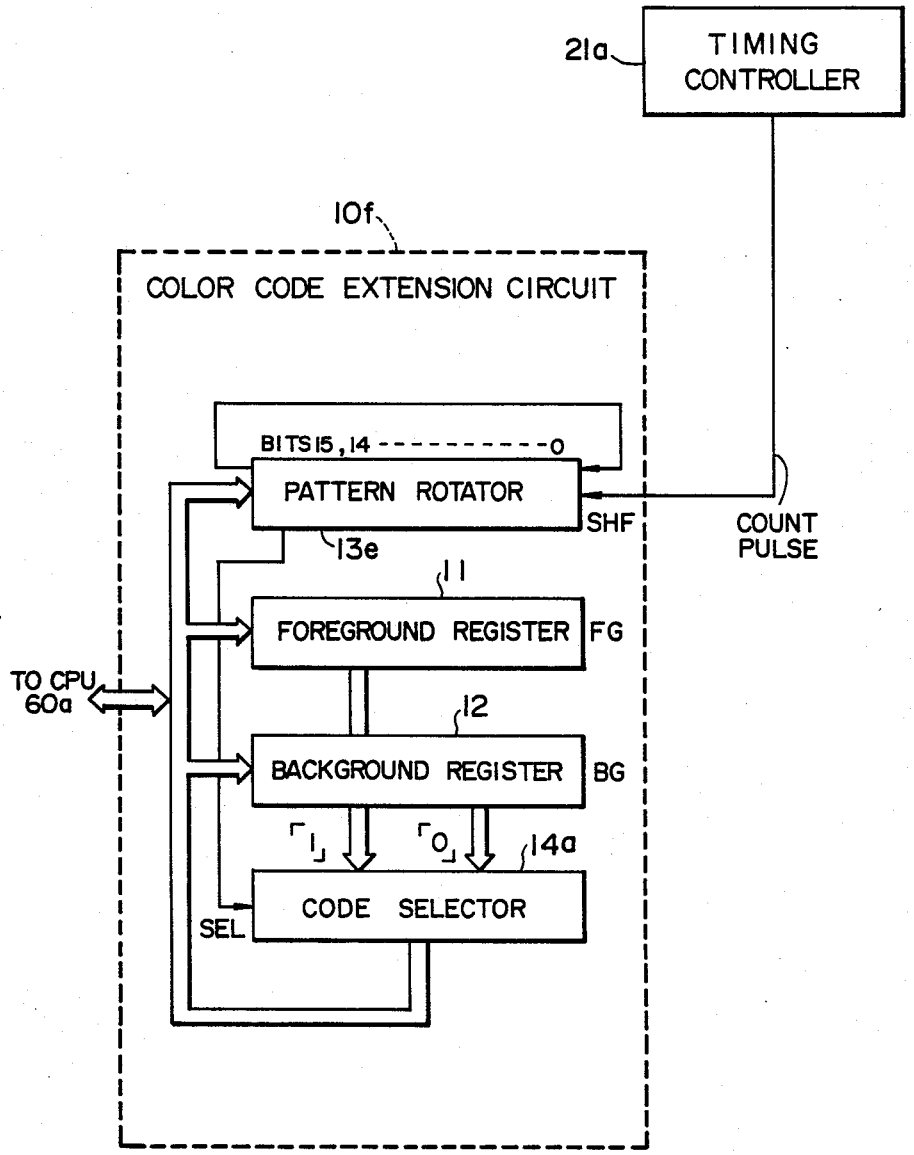
FIG. 11 is a block diagram of a still further embodiment of the invention.

Referring now to FIG. 11 there is illustrated a block diagram of a color code extension circuit 10f in which Pattern Rotator 13e is employed in place of Pattern Shift Register 13 in the embodiment shown in FIG. 6.

Figure 12:
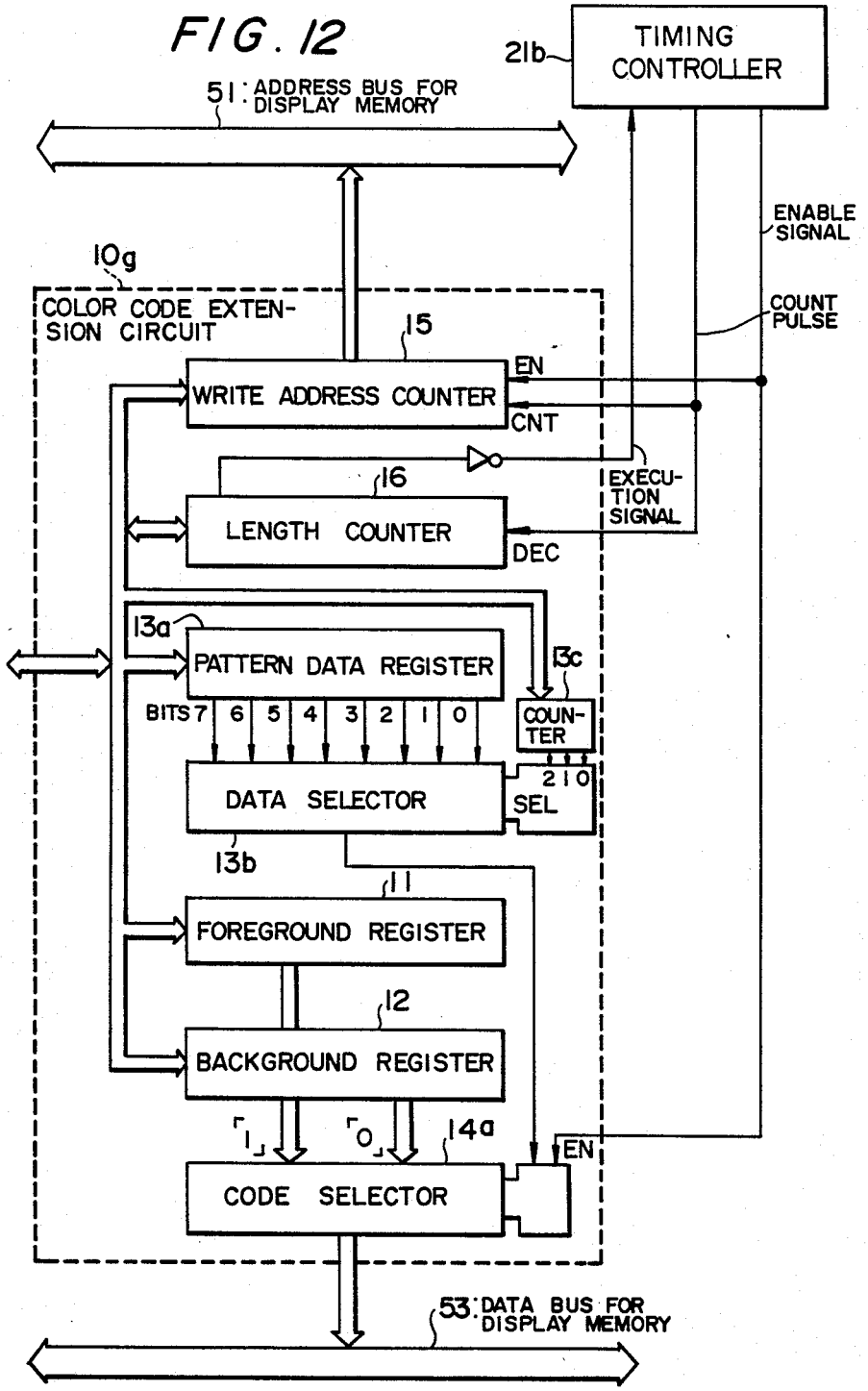
FIG. 12 is a block diagram of a modification of the color code extension circuit shown in FIG. 7.

Referring also to FIG. 12, there is illustrated a block diagram of a color code extension circuit 10g which is a modification of the embodiment shown in FIG. 7.

In this circuit 10g, there are provided Pattern Data Register 13a, Data Selector 13b and Counter 13c in place of Pattern Rotator 13e in Color Code Extension Circuit 10e shown in FIG. 10.

Pattern Data Register 13a is used to hold the pattern data to be extended to color codes and Data Selector 13b is dedicated to selecting the pattern data from Pattern Data Register 13a in a sequential manner. Counter 13c is adapted to output ascending or descending count data as the select signal of Selector 13b.

Pattern Data Register 13a, Data Selector 13b and Counter 13c cooperate to form a pattern data repetitive output means which is capable of holding therein the pattern data to be extending to color codes and of outputting the pattern data repetitively.

Also, Code Selector 14 is used to select the foreground or background color code according to the output of Data Selector 13b.

The operation of the color code extension circuit 10g shown in FIG. 12 is basically similar to that of the color code extension circuit 10e shown in FIG. 10.

However, the operation of the circuit 10g is different from that of the circuit 10e in that Pattern Data Register 13a receives the pattern data from CPU 60a and holds it therein, Data Selector 13b outputs bits, bit by bit, from the high-order bit of the pattern data, and either the foreground or background is selected by Code Selector 14a according to the output bit; and also in that Data Selector 13b outputs the data, bit by bit, sequentially from Pattern Data Register 13a in accordance with the output signal of Counter 13c. A pattern position at which the color code extension is to be started is set in Counter 13c by CPU 60a.

After all of the data received from CPU 60a and held therein (for example, 8-bit data) are output, Counter 13c repeats its outputs, so that the same pattern data can be extended to color codes repetitively.

In this case, since the pattern data has only to be written into Pattern Data Register 13a once, the time required for writing the pattern data can be saved.

Also, Data Selector 13b outputs the pattern data bitwise in accordance with the output signal of Counter 13c and, for this reason, the conversion operation to color codes can be initiated even at an intermediate point of Pattern Data Register 13a.

Figure 13:
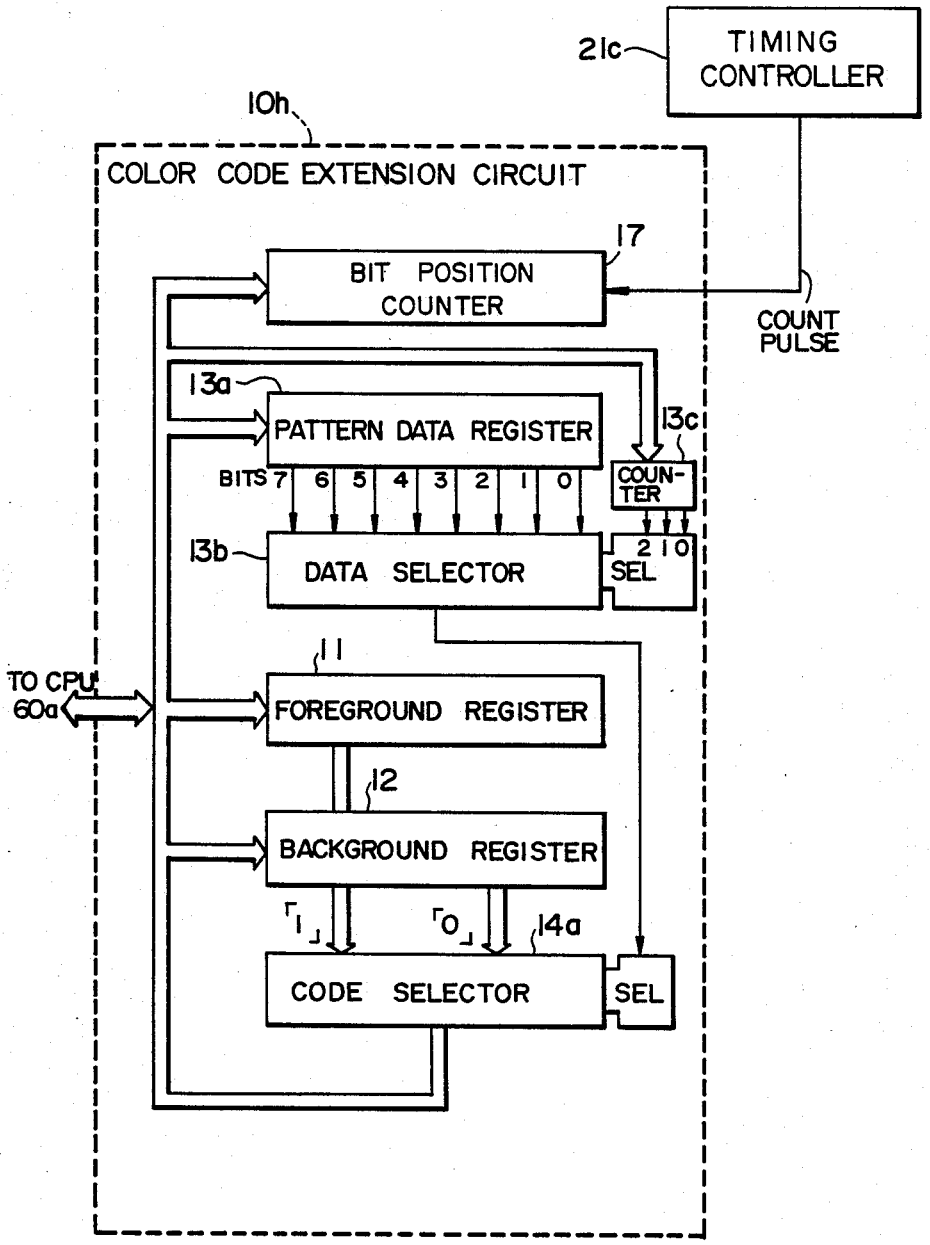
FIG. 13 is a block diagram of a modification of the modified color code extension circuit in FIG. 12.

Referring next to FIG. 13, there is illustrated a block diagram of a modified embodiment of the embodiment shown in FIG. 12, that is, a color code extension circuit 10h.

In the modified embodiment of FIG. 13, Write Address Counter 15 and Length Counter 16 are eliminated from the embodiment offig. 12, and Bit Position Center 17 is added thereto. In this case, the functions of Write Address Counter 15 and Length Counter 16 are executed by CPU 60a.

In other words, a continuous automatic operation in the color code extension is executed by CPU 60a, while Color Code Extension Circuit 10h with Counters 15, 16 excluded therefrom runs a simple color code extension operation. In this case, although the part of CPU 60a is increased to some extent, the performance of the whole system can be enhanced over the prior art system.

As has been described hereinbefore, the present invention is effective in that the operation of extending the character font patterns to the color codes can be expedited.

What is claimed is:

1. An image data processing system comprising:

color code extension circuit means including: a foreground register for storing foreground color codes, a background register for storing background color codes, a pattern shift register for storing pattern data to be extended to color codes and for shifting the patern data, and a selector for selectively outputting the foreground or background color codes in accordance with the contents of high-order bits of the pattern shift register;

control processor means for setting the foreground color codes, background color codes, pattern data information and corresponding computed addresses into said color code extension circuit means and for outputting an execution signal;

display controller means for outputting a display address corresponding to a display position of the screen and for generating a display signal to be displayed on a screen of a CRT from received corresponding color code data;

display memory means for receiving the display address from said display controller means and for receiving the corresponding output color codes from said color code extension circuit means and for outputting the corresponding color code data to said display controller means; and timing controller means for receiving the outputted execution signal from said control processor means and for controlling the timing in which said color code extension circuit means outputs the corresponding color codes to said display memory means.

2. The system in claim 1, said color extension circuit means further including:

a write address counter for holding the addresses to be written into said display memory means; and a length counter for holding length information of the pattern data to be extended to color codes.

3. An image data processing system comprising:

color code extension circuit means including: a foreground register for storing foreground color codes, a background register for storing background color codes, a pattern data register for storing pattern data to be extended to color codes, a data selector for sequentially selecting the pattern data from the pattern data register, and a code selector for selectively outputting the foreground or background color codes in accordance with the outputs of the data selector;

control processor means for setting the foreground color codes, background color codes, pattern data information and corresponding computed addresses into said color code extension circuit means and for outputting an execution signal;

display controller means for outputting a display address corresponding to a display position of the screen and for generating a display signal to be displayed on a screen of a CRT from received corresponding color code data;

display memory means for receiving the display address from said display controller means and for receiving the corresponding output color codes from said color code extension circuit means and for outputting the corresponding color code data to said display controller means; and timing controller means for receiving the outputted execution signal from said control processor means and for controlling the timing in which said color code extension circuit means outputs the corresponding color codes to said display memory means.

4. The system in claim 3, said color extension circuit means further including:

a write address counter for holding the addresses to be written into said display memory means; and a length counter for holding length information of the pattern data to be extended to color codes.

5. An image data processing system comprising:

color code extension circuit means including: a foreground register for storing foreground color codes, a background register for storing background color codes, a character font ram for storing character font patterns to be extended to color codes, a character code register for storing character codes to be read out, a data selector for sequentially selecting the character font patterns output from the character font ram, and a code selector for selectively outputting the foreground or background color codes in accordance with the outputs of the data selector;

control processor means for setting the foreground color codes, background color codes, pattern data information and corresponding computed addresses into said color code extension circuit means and for outputting an execution signal;

display controller means for outputting a display address corresponding to a display position of the screen and for generating a display signal to be displayed on a screen of a CRT from received corresponding color code data;

display memory means for receiving the display address from said display controller means and for receiving the corresponding output color codes from said color code extension circuit means and for outputting the corresponding color code data to said display controller means; and timing controller means for receiving the outputted execution signal from said control processor means and for controlling the timing in which said color code extension circuit means outputs the corresponding color codes to said display memory means.

* * * * *